US011375754B2

(12) United States Patent
Batista

(10) Patent No.: US 11,375,754 B2
(45) Date of Patent: Jul. 5, 2022

(54) AEROSOL-GENERATING DEVICE HAVING AN ELASTIC SUSCEPTOR

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 57 days.

(21) Appl. No.: 16/636,192

(22) PCT Filed: Aug. 9, 2018

(86) PCT No.: PCT/EP2018/071708
§ 371 (c)(1),
(2) Date: Feb. 3, 2020

(87) PCT Pub. No.: WO2019/030364
PCT Pub. Date: Feb. 14, 2019

(65) Prior Publication Data

US 2020/0367565 A1 Nov. 26, 2020

(30) Foreign Application Priority Data

Aug. 9, 2017 (EP) ..... 17185597

(51) Int. Cl.
*A24F 13/00* (2006.01)
*A24F 40/465* (2020.01)
(Continued)

(52) U.S. Cl.
CPC ..... *A24F 40/465* (2020.01); *A24F 40/57* (2020.01); *H05B 6/105* (2013.01); *A24F 40/20* (2020.01)

(58) Field of Classification Search
CPC ..... A24F 47/00
(Continued)

(56) References Cited

U.S. PATENT DOCUMENTS 9,055,617 B2 6/2015 Thorens et al.
10,028,535 B2 * 7/2018 Mironov ..... A24F 40/465
(Continued)

FOREIGN PATENT DOCUMENTS

CN 205863529 U 1/2017
EP 2797445 A1 11/2014
(Continued)

OTHER PUBLICATIONS

Extended European Search Report dated Dec. 1, 2017, in Patent Application No. 17185597.6, 7 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including a chamber; an inductor coil disposed around at least a portion of the chamber; an elastic susceptor element disposed within the chamber and having a tubular shape configured to receive at least a portion of an aerosol-generating article within the elastic susceptor element; and a power supply and a controller connected to the inductor coil and configured to provide an alternating electric current to the inductor coil such that the inductor coil generates an alternating magnetic field to inductively heat the elastic susceptor element and thereby heat at least a portion of the aerosol-generating article received within the elastic susceptor element.

20 Claims, 3 Drawing Sheets

(51) Int. Cl.
*A24F 40/57* (2020.01)
*H05B 6/10* (2006.01)
*A24F 40/20* (2020.01)

(58) Field of Classification Search
USPC ..... 131/328–329
See application file for complete search history.

(56) References Cited

U.S. PATENT DOCUMENTS

| | | | |
|---|---|---|---|
| 2004/0149737 | A1 | 8/2004 | Sharpe et al. |
| 2011/0155153 | A1 | 6/2011 | Thorens et al. |
| 2014/0305449 | A1 | 10/2014 | Plojoux et al. |
| 2015/0264979 | A1 | 9/2015 | Thorens et al. |
| 2016/0295921 | A1 | 10/2016 | Mironov et al. |
| 2017/0055583 | A1 | 3/2017 | Blandino et al. |
| 2017/0311648 | A1 | 11/2017 | Gill et al. |
| 2018/0279685 | A1 | 10/2018 | Thorens et al. |

FOREIGN PATENT DOCUMENTS

| | | | |
|---|---|---|---|
| KR | 10-2017-0083600 | | 7/2017 |
| RU | 2 600 912 | C1 | 10/2016 |
| RU | 2 602 053 | C2 | 11/2016 |
| WO | WO 2015/177043 | A1 | 11/2015 |
| WO | WO 2015/177264 | A1 | 11/2015 |
| WO | WO 2017/186455 | A1 | 11/2017 |
| WO | WO 2019/030000 | A1 | 2/2019 |
| WO | WO 2019/030301 | A1 | 2/2019 |
| WO | WO 2019/030353 | A1 | 2/2019 |
| WO | WO 2019/030360 | A1 | 2/2019 |
| WO | WO 2019/030361 | A1 | 2/2019 |
| WO | WO 2019/030363 | A1 | 2/2019 |
| WO | WO 2019/030364 | A1 | 2/2019 |
| WO | WO 2019/030366 | A1 | 2/2019 |

OTHER PUBLICATIONS

International Search Report and Written Opinion dated Nov. 20, 2018 in PCT/EP2018/071708 filed on Aug. 9, 2018.

Combined Russian Office Action and Search Report dated Nov. 18, 2021 in Russian Patent Application No. 2020109862/03 (with English language translation), 17 pages.

* cited by examiner

AEROSOL-GENERATING DEVICE HAVING AN ELASTIC SUSCEPTOR

CROSS-REFERENCE TO RELATED APPLICATIONS

This application is a U.S. national stage application of PCT/EP2018/071708, filed on Aug. 9, 2018, which is based upon and claims the benefit of priority from European patent application no. 17185597.6, filed Aug. 9, 2017, the entire contents of each of which are incorporated herein by reference.

TECHNICAL FIELD

The present invention relates to an aerosol-generating device comprising an inductor coil and an elastic susceptor element. The present invention also relates to an aerosol-generating system comprising the aerosol-generating device and an aerosol-generating article for use with the aerosol-generating device.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and an electrically conductive susceptor element within the aerosol-generating device and arranged such that it is in thermal proximity to the aerosol-forming substrate. During use, the inductor generates an alternating magnetic field to generate eddy currents and hysteresis losses in the susceptor element, causing the susceptor element to heat up, thereby heating the aerosol-forming substrate.

The present inventors have recognised that, to optimise heating of an aerosol-generating article in an inductive heating system, the system is preferably configured to optimise contact between the article and the susceptor element, and minimise the distance between the inductor and the susceptor element. However, in known devices this may result in a close fit of the aerosol-generating article within the device. This may make it difficult for a user to insert an article into the device, remove an article from the device, or both. The close fit may also reduce manufacturing tolerances with respect to the dimensions of the article, which may increase the cost of the article.

It would be desirable to provide an aerosol-generating device comprising an inductive heating system that mitigates or overcomes these problems with known systems.

SUMMARY

According to a first aspect of the present invention there is provided an aerosol-generating device comprising a chamber, an inductor coil disposed around at least a portion of the chamber, and an elastic susceptor element positioned within the chamber. The elastic susceptor element has a tubular shape for receiving at least a portion of an aerosol-generating article within the elastic susceptor element. The aerosol-generating device also comprises a power supply and a controller connected to the inductor coil and configured to provide an alternating electric current to the inductor coil such that, in use, the inductor coil generates an alternating magnetic field to inductively heat the elastic susceptor element and thereby heat at least a portion of an aerosol-generating article received within the elastic susceptor element.

According to a second aspect of the present invention there is provided an aerosol-generating system. The aerosol-generating system comprises an aerosol-generating device according to the first aspect of the present invention, in accordance with any of the embodiments described herein. The aerosol-generating system also comprises an aerosol-generating article having an aerosol-forming substrate and configured for use with the aerosol-generating device.

According to a third aspect of the present invention there is provided an elastic susceptor element for heating an aerosol-generating article, the elastic susceptor element having a tubular shape for receiving at least a portion of an aerosol-generating article within the elastic susceptor element. The elastic susceptor element may comprise any of the optional and preferred features described herein with reference to the first aspect of the present invention.

BRIEF DESCRIPTION OF THE DRAWINGS

The invention will be further described, by way of example only, with reference to the accompanying drawings in which.

DETAILED DESCRIPTION

Figure 1:
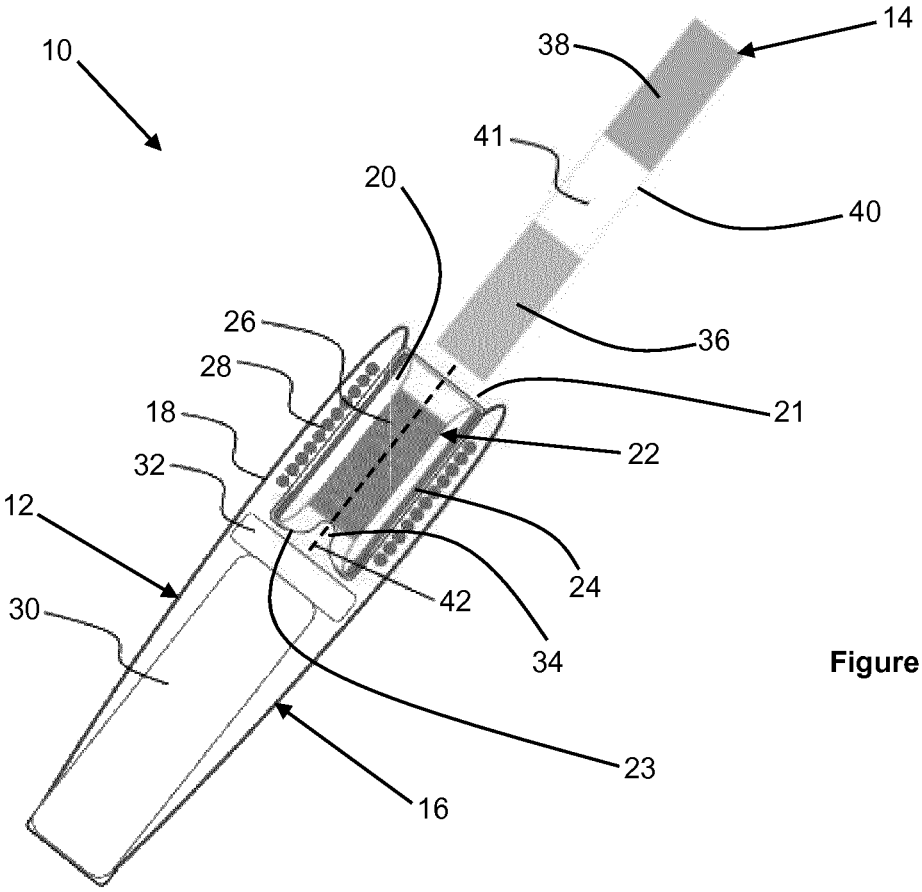
FIG. 1 shows a cross-sectional view of an aerosol-generating system according to any embodiment of the present invention.

As used herein, the term "longitudinal" is used to describe the direction along the main axis of the aerosol-generating device, or of an aerosol-generating article, and the term 'transverse' is used to describe the direction perpendicular to the longitudinal direction. When referring to the chamber and the elastic susceptor element, the term 'longitudinal' refers to the direction in which an aerosol-generating article is inserted into the elastic susceptor element and the term 'transverse' refers to a direction perpendicular to the direction in which an aerosol-generating article is inserted into the elastic susceptor element.

As used herein, the term "width" refers to the major dimension in a transverse direction of a component of the aerosol-generating device, or of an aerosol-generating article, at a particular location along its length. The term "thickness" refers to the dimension of a component of the aerosol-generating device, or of an aerosol-generating article, in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In an aerosol-generating system, the aerosol-generating article and the aerosol-generating device cooperate to generate a respirable aerosol.

As used herein, the term "elongate" refers to a component having a length which is greater than both its width and thickness, for example twice as great.

As used herein, a "susceptor element" means an electrically conductive element that heats up when subjected to a changing magnetic field. This may be the result of eddy currents induced in the susceptor element, hysteresis losses, or both eddy currents and hysteresis losses. The susceptor element is located in thermal contact or close thermal proximity with the aerosol-forming substrate of an aerosol-generating article received in the elastic susceptor element of the aerosol-generating device. In this manner, the aerosol-forming substrate is heated by the susceptor element during use such that an aerosol is formed.

Advantageously, providing an inductor coil and a susceptor element as parts of the aerosol-generating device makes it possible to construct an aerosol-generating article that is simple, inexpensive and robust. Aerosol-generating articles are typically disposable and produced in much larger numbers that the aerosol-generating devices with which they operate. Accordingly, reducing the cost of the articles, even if it requires a more expensive device, can lead to significant cost savings for both manufacturers and consumers.

Advantageously, the use of inductive heating rather than resistive heating may provide improved energy conversion because of power losses associated with a resistive heater, in particular losses due to contact resistance at connections between the resistive heater and the power supply.

Advantageously, providing the aerosol-generating device with an elastic susceptor element may allow the susceptor element to conform to an outer size and shape of an aerosol-generating article received within the susceptor element. For example, the elastic susceptor element may stretch or deform to accommodate the size and shape of the aerosol-generating article. Advantageously, this may optimise contact between the susceptor element and the aerosol-generating article. Advantageously, this may optimise the transfer of heat from the susceptor element to the aerosol-generating article during use. Advantageously, the elastic susceptor element can retain these advantages while also accommodating aerosol-generating articles having different shapes, sizes, or both. Advantageously, this may facilitate use of the aerosol-generating device with more than one type of aerosol-generating article.

Advantageously, configuring the elastic susceptor element to receive at least a portion of an aerosol-generating article within the elastic susceptor element may reduce or minimise a distance between the susceptor element and the inductor coil. For example, receiving an aerosol-generating article within the elastic susceptor element positions the susceptor element around an exterior of the aerosol-generating article. This may position the susceptor element adjacent an inner surface of the chamber, which may reduce or minimise the distance between the susceptor element and the inductor coil disposed around the chamber.

Advantageously, the elastic susceptor element may facilitate insertion of an aerosol-generating article into the aerosol-generating device. For example, the susceptor element may stretch or deform when an aerosol-generating article is inserted into the aerosol-generating device. This may reduce a force required to insert the aerosol-generating article into the aerosol-generating device.

Advantageously, the elasticity of the elastic susceptor element may facilitate retention of the aerosol-generating article within the aerosol-generating device during use. For example, the susceptor element may stretch or deform when an aerosol-generating article is inserted into the aerosol-generating device. This may result in the elasticity of the susceptor element exerting a force on the aerosol-generating article while the article is received within the aerosol-generating device.

Advantageously, the elasticity of the elastic susceptor element may maintain contact between the elastic susceptor element and an aerosol-generating article during use. For example, some aerosol-generating articles, such as those comprising a tobacco plug, may exhibit shrinkage during heating and consumption of the aerosol-generating article. Therefore, where the susceptor element stretches or deforms when the aerosol-generating article is inserted into the aerosol-generating device, the elasticity may result in the elastic susceptor element contracting around the aerosol-generating article as the aerosol-generating article shrinks.

Advantageously, the elasticity combined with the tubular shape of the elastic susceptor element may facilitate correct positioning of an aerosol-generating article within the chamber. In particular, the elastic susceptor element may facilitate positioning of an aerosol-generating article along a central axis of the chamber. For example, positioning an aerosol-generating article in the chamber so that it is spaced apart from the central axis, or at an angle to the central axis, or both, may cause asymmetric stretching of the tubular susceptor element. The asymmetric stretching may result in the elastic force exerted on the aerosol-generating article by the elastic susceptor element being distributed asymmetrically about the aerosol-generating article. This may provide a net force on the aerosol-generating article that biases the aerosol-generating article towards the central axis of the chamber.

The tubular elastic susceptor element may have any suitable cross-sectional shape. The cross-sectional shape may comprise at least one of circular, elliptical, triangular, rectangular, including square, or any other polygonal shape. Preferably, the tubular elastic susceptor element comprises at least one of a circular or elliptical cross-sectional shape. Preferably, the tubular elastic susceptor element has a substantially circular cross-sectional shape. The tubular elastic susceptor element may have a cross-sectional shape that varies in at least one of area and shape along a length of the elastic susceptor element.

Preferably, the elastic susceptor element is disposed coaxially within the chamber. Preferably, the chamber comprises a central axis, wherein the elastic susceptor is disposed symmetrically about the central axis.

The chamber may comprise a closed end, an open end and a central axis extending between the closed end and the open end. In use, an aerosol-generating article may be inserted into the aerosol-generating device through the open end of the chamber and in a direction along the central axis.

Preferably, at least a portion of the elastic susceptor element comprise a radial elasticity to bias the elastic susceptor element away from an inner surface of the chamber and towards the central axis. Advantageously, the radial elasticity may bias the elastic susceptor element against an outer surface an aerosol-generating article received within the elastic susceptor element.

The elastic susceptor element may comprise a tubular substrate and a susceptor material supported by the tubular substrate. Advantageously, a material forming the tubular substrate may be optimised for providing at least one of mechanical strength of the elastic susceptor element and the elasticity of the elastic susceptor element. Advantageously, the susceptor material may be optimised for inductive heating by the inductor coil.

Preferably, the tubular substrate comprises a woven material. Advantageously, a woven material may provide improved control over the elasticity of the elastic susceptor element. For example, the woven material may be formed from fibres having an inherent elasticity. Additionally, or alternatively, the woven material may comprise a weave that provides a degree of elasticity to the tubular structure. Advantageously, the weave of the woven material may be selected to provide the tubular structure with a directional elasticity. For example, the weave may be selected so that the tubular structure exhibits greater stretch in a radial direction of the tubular structure than a longitudinal direction of the tubular structure.

Preferably, at least a portion of the woven material is porous. Advantageously, one or more porous portions may facilitate airflow through the woven material. That is, the one or more porous portions may be permeable. Advantageously, this may facilitate airflow through the aerosol-generating device during use. The woven material may be substantially entirely porous.

In embodiments in which the chamber comprises a closed end and an open end, a thread count of the woven material may vary along a length of the tubular substrate between the closed end and the open end.

Advantageously, the variation in the thread count may provide the tubular structure with a varying elasticity along its length. Portions of the tubular structure with a higher thread count may exert a larger elastic force against an aerosol-generating article received within the aerosol-generating device. The woven material may comprise a first region adjacent the open end of the chamber and having a first thread count, and a second region between the first region and the closed end of the chamber, wherein the second region has a second thread count that is higher than the first thread count. Advantageously, the lower thread count in the first region may facilitate insertion of an aerosol-generating article into the aerosol-generating device.

Advantageously, the variation in the thread count may provide the tubular structure with a varying permeability along its length. Portions of the tubular structure with a lower thread count may exhibit higher permeability. Advantageously, portions of the tubular structure exhibiting higher permeability may facilitate airflow through the tubular structure.

In embodiments in which the tubular structure comprises a first region having a first thread count and a second region having a second thread count, the tubular structure may further comprise a third region adjacent the closed end of the chamber and having a third thread count, wherein the second region is positioned between the first and second regions, and wherein the second thread count is higher than the first thread count and the third thread count. Advantageously, the first and third regions may facilitate airflow through the tubular structure at the open and closed ends of the chamber.

Suitable fibres for forming the woven material include polymeric fibres, mineral fibres, silica fibres, carbon fibres, and combinations thereof. An exemplary woven material comprises a graphene-based woven fabric formed from woven graphene micro-ribbons.

The susceptor material may comprise a material deposited onto a surface of the tubular structure.

In embodiments in which the tubular structure comprises a woven material, preferably the susceptor material comprises a plurality of susceptor fibres interwoven with the woven material of the tubular substrate.

Suitable susceptor materials include any material that can be inductively heated to a temperature sufficient to aerosolise an aerosol-forming substrate. Suitable susceptor materials include graphite, molybdenum, silicon carbide, stainless steels, niobium, and aluminium. Preferred susceptor materials comprise a metal or carbon. Preferably, the susceptor material comprises or consists of a ferromagnetic material, for example, ferritic iron, a ferromagnetic alloy, such as ferromagnetic steel or stainless steel, ferromagnetic particles, and ferrite. A suitable susceptor material may be, or comprise, aluminium. The susceptor material preferably comprises more than about 5 percent, preferably more than about 20 percent, more preferably more than about 50 percent or more than 90 percent of ferromagnetic or paramagnetic materials. Preferred susceptor materials may be heated to a temperature in excess of about 250 degrees Celsius.

The susceptor material may extend over substantially all of the tubular structure.

The susceptor material may extend over only one or more portions of the tubular structure. Advantageously, this may provide a desired heating profile across the chamber during use. Preferably, the susceptor material is positioned on the tubular structure so that the susceptor material overlies an aerosol-forming substrate of an aerosol-generating article when the article is received within the aerosol-generating device.

In embodiments in which the tubular structure comprises a region having a higher thread count than one or more other regions of the tubular structure, preferably the susceptor material is positioned on the region having the higher thread count. In embodiments in which the tubular structure comprises at least first and second regions having first and second thread counts, preferably the susceptor material is positioned on the second region.

The susceptor material may be provided on the tubular structure as one or more discrete areas of susceptor material. The susceptor material may comprise a plurality of areas of susceptor material each supported by a portion of the tubular substrate, wherein the areas of susceptor material are spaced apart from each other. In embodiments in which the chamber comprises a closed end and an open end, preferably the areas of susceptor material are spaced apart from each other along a length of the tubular substrate between the closed end and the open end.

The inductor coil may comprise a plurality of inductor coils, wherein the elastic susceptor element comprises a total number of areas of susceptor material, and wherein each inductor coil is disposed around less than the total number of areas of susceptor material. Preferably, each inductor coil is disposed around only one of the areas of susceptor material.

Preferably, the susceptor material forms a first band of susceptor material extending around a first portion of the tubular structure. The susceptor material may comprise a second band of susceptor material extending around a second portion of the tubular structure, wherein the first and second bands of susceptor material are spaced apart from each other along a length of the tubular structure.

The inductor coil may extend around both the first and second bands of susceptor material. Advantageously, this may facilitate simultaneous heating of two separate portions of an aerosol-generating article received within the aerosol-generating device. This may be particularly advantageous in embodiments in which the aerosol-generating article comprises two discrete aerosol-forming substrates, for example.

The inductor coil may be a first inductor coil disposed around a first portion of the chamber and extending around the first band of susceptor material. The aerosol-generating device may further comprise a second inductor coil disposed around a second portion of the chamber and extending around the second band of susceptor material. Advantageously, this may facilitate the sequential heating of two discrete aerosol-forming substrates in an aerosol-generating article, or the sequential heating of two portions of a single aerosol-forming substrate.

In embodiments comprising first and second inductor coils, the controller may be configured to provide an alternating electric current to the first inductor coil for a first time period and configured to provide an alternating electric current to the second inductor coil for a second time period. The first and second time periods may partially overlap. The first and second time periods may be non-overlapping.

The aerosol-generating device may comprise a tubular housing part. Preferably, the tubular housing part at least partially defines the chamber. The housing may comprise an outer housing and the tubular housing part positioned within the outer housing. Preferably, the inductor coil is disposed between the tubular housing part and the outer housing. Preferably, the inductor coil is wound around an outer surface of the tubular housing part. Advantageously, forming the housing from a tubular housing part and an outer housing may facilitate assembly of the aerosol-generating device. For example, the inductor coil may be wound around the tubular housing part before the tubular housing part and the inductor coil are inserted as a single element into the outer housing.

Preferably, the elastic susceptor element comprises a central portion positioned within the tubular housing part, a first end portion extending out of a first end of the tubular housing part, and a second end portion extending out of a second end of the tubular housing part. Preferably, the first end portion of the elastic susceptor element is folded around the first end of the tubular housing part and secured to an outer surface of the tubular housing part, and the second end portion of the elastic susceptor element is folded around the second end of the tubular housing part and secured to the outer surface of the tubular housing part.

Advantageously, the tubular housing part supports the elastic susceptor assembly within the aerosol-generating device.

Advantageously, this arrangement may simplify the assembly of the aerosol-generating device. For example, the elastic susceptor element may be inserted into the tubular housing part and the first and second end portions of the elastic susceptor element may be folded back and secured to the outer surface of the tubular housing part. This step may form a susceptor assembly comprising the elastic susceptor element and the tubular housing part. Advantageously, the susceptor assembly may be easily combined with other elements of the aerosol-generating device. For example, in embodiments in which the housing comprises an outer housing, the susceptor assembly may be inserted into the outer housing.

In embodiments in which the chamber comprises a closed end, the closed end of the chamber may be substantially planar.

Preferably, the aerosol-generating device comprises at least one of a recess and a projection at the closed end of the chamber. Advantageously, the recess, the projection, or both, may interact with an aerosol-generating article inserted into the aerosol-generating device to locate the aerosol-generating article in a desired position within the chamber. Preferably, the recess, the projection, or both, interacts with the aerosol-generating article to position the article along a central axis of the chamber.

Preferably, the aerosol-generating device comprises a projection extending into the chamber from the closed end. The projection may be formed by part of the housing. The projection may be configured to abut an end of an aerosol-generating article inserted into the aerosol-generating device. The projection may be configured for insertion into an aerosol-generating article inserted into the aerosol-generating device. The projection may comprise at least one of a pin, rod, blade, or plate.

The projection may comprise a susceptor material. Preferably, at least a portion of the inductor coil is disposed around at least a portion of the projection. Advantageously, during use, the inductor coil inductively heats the projection comprising a susceptor material. Advantageously, this may provide additional heating of an aerosol-forming substrate of an aerosol-generating article received within the aerosol-generating device. This may be particularly advantageous in embodiments in which the projection is configured for insertion into an aerosol-generating article inserted into the aerosol-generating device.

Suitable susceptor materials for forming the projection include graphite, molybdenum, silicon carbide, stainless steels, niobium, and aluminium. Preferred susceptor materials comprise a metal or carbon. Preferably, the susceptor material comprises or consists of a ferromagnetic material, for example, ferritic iron, a ferromagnetic alloy, such as ferromagnetic steel or stainless steel, ferromagnetic particles, and ferrite. A suitable susceptor material may be, or comprise, aluminium. The susceptor material preferably comprises more than about 5 percent, preferably more than about 20 percent, more preferably more than about 50 percent or more than 90 percent of ferromagnetic or paramagnetic materials. Preferred susceptor materials may be heated to a temperature in excess of about 250 degrees Celsius.

The projection may comprise a non-metallic core with a metal layer disposed on the non-metallic core. For example, the projection may comprise one or more metallic tracks formed on an outer surface of a ceramic core or substrate.

The projection may have a protective external layer, for example a protective ceramic layer or protective glass layer. The protective external layer may encapsulate the susceptor material. The projection may comprise a protective coating formed by a glass, a ceramic, or an inert metal, formed over a core of susceptor material.

The projection may have any suitable cross-section. For example, the projection may have a square, oval, rectangular, triangular, pentagonal, hexagonal, or similar cross-sectional shape. The projection may have a planar or flat cross-sectional area.

The projection may be solid, hollow, or porous. Preferably, projection is solid.

Preferably, the projection has a length of between about 5 millimetres and about 15 millimetres, for example between about 6 millimetres and about 12 millimetres, or between about 8 millimetres and about 10 millimetres. The projection preferably has a width of between about 1 millimetre and about 8 millimetres, more preferably from about 3 millimetres to about 5 millimetres. The projection may have a thickness of from about 0.01 millimetres to about 2 millimetres. If the projection has a constant cross-section, for example a circular cross-section, it has a preferable width or diameter of between about 1 millimetre and about 5 millimetres.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The aerosol-generating device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the device, for example a button to initiate heating of the device or display to indicate a state of the device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between about 500 kilohertz and about 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to the inductor coil and the power supply. The controller is configured to control the supply of power to the inductor coil from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to the inductor coil continuously following activation of the aerosol-generating device or may be supplied intermittently, such as on a puff by puff basis. The controller may advantageously comprise DC/AC inverter, which may comprise a Class-D or Class-E power amplifier.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the article is partially received within the chamber of the aerosol-generating device. The chamber of the aerosol-generating device and the aerosol-generating article may be arranged such that the article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Figure 2:
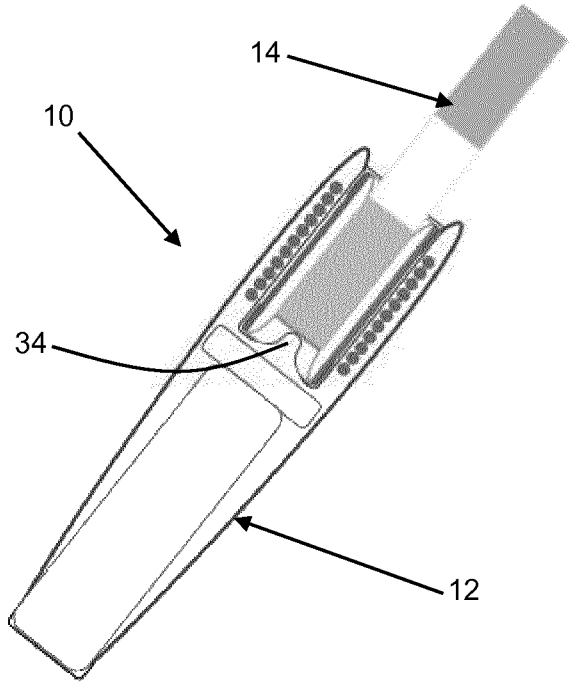
FIG. 2 shows a cross-sectional view of the aerosol-generating system of FIG. 1 with the aerosol-generating article inserted into the aerosol-generating device.

FIGS. 1 and 2 show cross-sectional views of an aerosol-generating system 10 according to an embodiment of the present invention. The aerosol-generating system 10 comprises an aerosol-generating device 12 and an aerosol-generating article 14. FIG. 1 shows the aerosol-generating article 14 separate from the aerosol-generating device 12. FIG. 2 shows a portion of the aerosol-generating article 14 inserted into the aerosol-generating device 12.

The aerosol-generating device 12 comprises a housing 16 comprising an outer housing 18. The aerosol-generating device 12 also comprises a chamber 20 for receiving a portion of the aerosol-generating article 14 through an open end 21 of the chamber 20.

Positioned within the chamber 20 is a susceptor assembly 22 comprising a tubular housing part 24 and an elastic susceptor element 26. When the aerosol-generating article 14 is inserted into the aerosol-generating device 12 the aerosol-generating article 14 is received within the elastic susceptor element 26.

The aerosol-generating device 12 also comprises an inductor coil 28 disposed in the housing 16 between the outer housing 18 and the tubular housing part 24. The inductor coil 28 extends around the chamber 20.

The aerosol-generating device 12 further comprises a power supply 30, a controller 32 and a projection 34. The projection 34 extends into the chamber 20 from a closed end 23 of the chamber 20.

The aerosol-generating article 14 comprises an aerosol-forming substrate 36 in the form of a tobacco plug and a mouthpiece 38 comprising a cellulose acetate filter. The aerosol-forming substrate 36 and the mouthpiece 38 are secured together in a spaced apart relationship by an outer wrapper 40 to define a space 41 between the aerosol-forming substrate 36 and the mouthpiece 38.

During use, the aerosol-generating article 14 is inserted into the chamber 20 of the aerosol-generating device 12 so that the aerosol-forming substrate 36 is received within the elastic susceptor element 26. When the aerosol-generating article 14 is inserted into the elastic susceptor element 26, the elastic susceptor element 26 stretches and deforms to accommodate the exterior size and shape of the aerosol-generating article 14. The elasticity of the elastic susceptor element 26 biases the elastic susceptor element 26 against the aerosol-forming article 14 to retain the aerosol-forming article 14 within the chamber 20.

The projection 34 engages the aerosol-forming substrate 36 to locate the aerosol-generating article 14 in a desired position within the chamber 20. Specifically, the projection 34 and the elastic susceptor element 26 position the aerosol-generating article 14 along a central axis 42 of the elastic susceptor element 26, the chamber 20 and the aerosol-generating device 12. The projection 34 also spaces an end of the aerosol-generating article 14 away from the closed end 23 of the chamber 20 to allow airflow to enter the end of the aerosol-generating article 14, as described herein with reference to FIG. 6.

When the aerosol-generating article 14 is inserted into the chamber 20, the controller 32 provides an alternating electric current from the power supply 30 to the inductor coil 28 to generate an alternating magnetic field. The alternating magnetic field inductively heats the elastic susceptor element 26, which heats the aerosol-forming substrate 36 to generate an aerosol.

Figure 3:
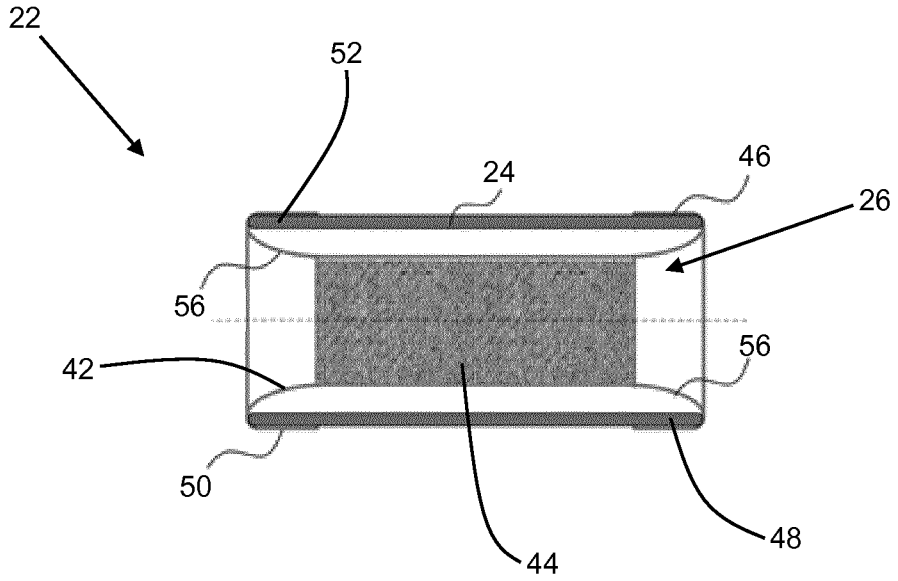
FIG. 3 shows a cross-sectional view of the susceptor assembly of the aerosol-generating device of FIG. 1.

FIG. 3 shows a cross-sectional view of the susceptor assembly 22. The elastic susceptor element 26 comprises a tubular structure 42 formed from a woven graphene material. The elastic susceptor element 26 also comprises a band of susceptor material 44 comprising ferromagnetic fibres interwoven with the woven graphene material at a central region of the tubular structure 42. The tubular structure 42 exhibits a radial elasticity that biases the central region of the tubular structure 42 away from the tubular housing part 24. The central region of the tubular structure 42 is positioned within the tubular housing part 24. A first end 46 of the tubular structure 42 is folded back over a first end 48 of the tubular housing part 24 and secured to an outer surface of the tubular housing part 24 by an adhesive. A second end 50 of the tubular structure 42 is folded back over a second end 52 of the tubular housing part 24 and secured to an outer surface of the tubular housing part 24 by an adhesive.

Figure 4:
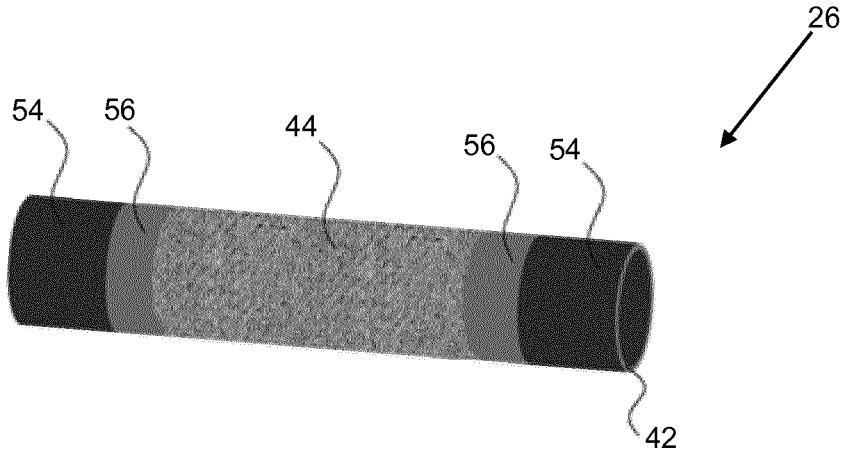
FIG. 4 shows a perspective view of the elastic susceptor element of the susceptor assembly of FIG. 3.

FIG. 4 shows a perspective view of the elastic susceptor element 26 before it is combined with the tubular housing part 24 to form the susceptor assembly 22. The woven graphene material forming the tubular structure 42 has a thread count that varies along the length of the tubular structure 42.

The varying thread count defines regions 54 of high thread count at the ends of the tubular structure 42. The regions 54 of high thread count may exhibit increase strength and form the first and second ends 46, 50 of the tubular structure 42 which are folded back and secured to the outer surface of the tubular housing part 24.

The varying thread count also defines regions 56 of low thread count adjacent each end of the band of susceptor material 44. The regions 56 of low thread count exhibit increased permeability and facilitate airflow through the elastic susceptor element 26, as described herein with reference to FIG. 6.

Figure 5:
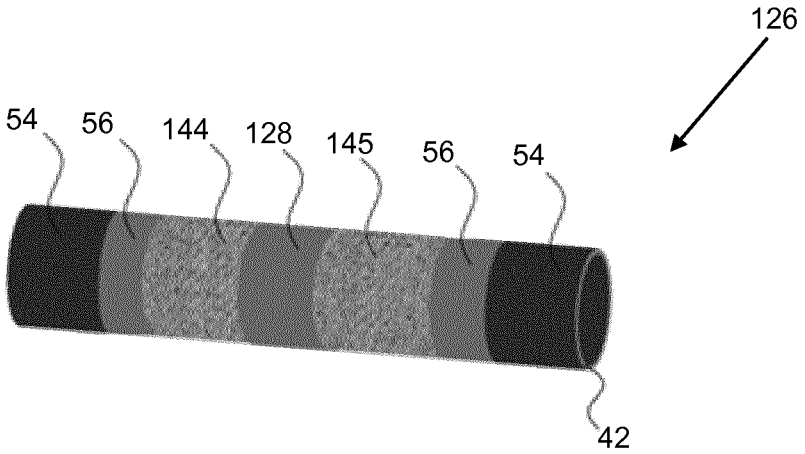
FIG. 5 shows a perspective view of an alternative elastic susceptor element.

FIG. 5 shows a perspective view of an alternative elastic susceptor element 126. The elastic susceptor element 126 shown in FIG. 5 is similar to the elastic susceptor element 26 shown in FIG. 4, and like reference numerals are used to designate like parts. The elastic susceptor element 126 differs in the configuration of the susceptor material. In particular, the elastic susceptor element 126 comprises a first band of susceptor material 144 and a second band of susceptor material 145 spaced apart from the first band of susceptor material 144. Both the first and second bands of susceptor material 144, 145 comprise ferromagnetic fibres interwoven with the woven graphene material forming the tubular structure 42. A central region 128 of the tubular structure 42 may be a region of low thread count similar to regions 56, high thread count similar to regions 54, or a region with a thread count in between the thread counts of the regions 54, 56.

The elastic susceptor element 126 may be suitable for heating an aerosol-generating article comprising first and second aerosol-forming substrates. For example, the first band of susceptor material 144 may be positioned to heat a first aerosol-forming substrate and the second band of susceptor material 145 may be positioned to heat a second aerosol-forming substrate. In such embodiments, the inductor coil 28 may extend around both bands of susceptor material 144, 145 inductively heat both bands of susceptor material 144, 145 simultaneously.

The elastic susceptor element 126 may also be suitable for sequentially heating different portions of an aerosol-generating article. In such embodiments, the aerosol-generating device may be modified to include a first inductor coil extending around the first band of susceptor material 144 and a second inductor coil extending around the second band of susceptor material 145. In such embodiments, the controller may provide separate alternating electric currents from the power supply to the first and second inductor coils over different time periods.

Figure 6:
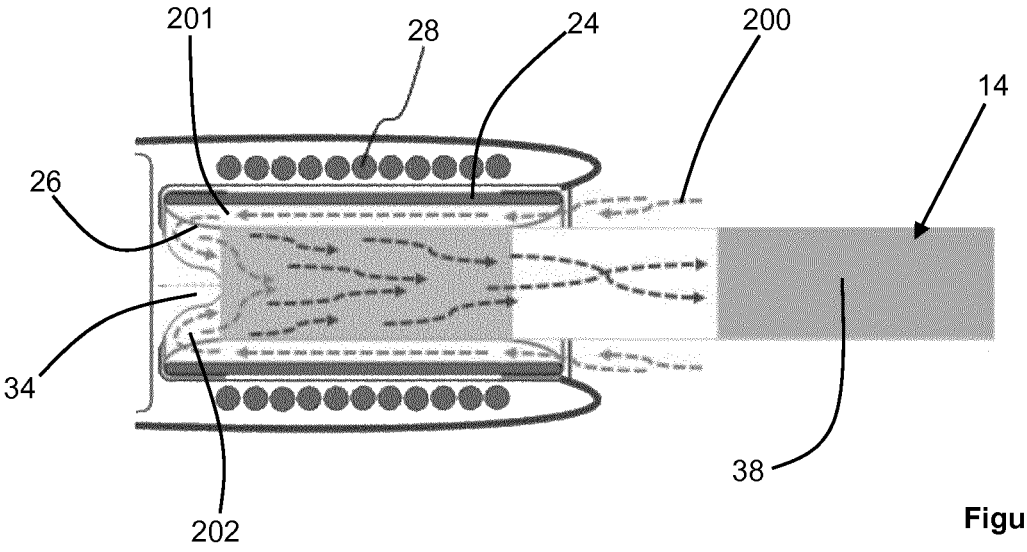
FIG. 6 shows an enlarged cross-sectional view of part of the aerosol-generating system of FIG. 2.

FIG. 6 shows an enlarged cross-section view of a portion of the aerosol-generating system 10 of FIG. 2. In particular, FIG. 6 shows the airflow through the aerosol-generating system 10 during use.

When a user draws on the mouthpiece 38 of the aerosol-generating article 14, airflow 200 is drawn into the chamber 20 of the aerosol-generating device 12 at its open end 21. The airflow 200 flows through a first region 56 of low thread count of the tubular structure 42 of the elastic susceptor element 26. The airflow 200 then flows through the space 201 between the elastic susceptor element 26 and the tubular housing part 24, at which point it is heated by the band of susceptor material 44. The airflow 200 then flows through a second region 56 of low thread count of the tubular structure 42 and into a space 202 formed within the chamber 20 between the closed end 23 of the chamber 20 and an end of the aerosol-generating article 14. The projection 34 maintains the space 202 between the closed end 23 of the chamber 20 and the aerosol-generating article 14. Next, the airflow 200 flows into the aerosol-forming substrate 36 of the aerosol-generating article 14, at which point aerosol generated by the heated aerosol-forming substrate 36 is entrained within the airflow 200. The airflow 200 and aerosol then flows through the space 41 and the mouthpiece 38 for delivery to the user.

The invention claimed is:

1. An aerosol-generating device, comprising:

a chamber;

an inductor coil disposed around at least a portion of the chamber;

an elastic susceptor element disposed within the chamber and having a tubular shape configured to receive at least a portion of an aerosol-generating article within the elastic susceptor element; and a power supply and a controller connected to the inductor coil and configured to provide an alternating electric current to the inductor coil such that the inductor coil generates an alternating magnetic field to inductively heat the elastic susceptor element and thereby heat at least a portion of the aerosol-generating article received within the elastic susceptor element.

2. The aerosol-generating device according to claim 1, wherein the chamber comprises a closed end, an open end, and a central axis extending between the closed end and the open end, and wherein at least a portion of the elastic susceptor element comprises a radial elasticity configured to bias the elastic susceptor element away from an inner surface of the chamber and towards the central axis.

3. The aerosol-generating device according to claim 1, wherein the elastic susceptor element comprises a tubular substrate and a susceptor material supported by the tubular substrate.

4. The aerosol-generating device according to claim 3, wherein the tubular substrate comprises a woven material.

5. The aerosol-generating device according to claim 4, wherein the chamber comprises a closed end and an open end, and wherein a thread count of the woven material varies along a length of the tubular substrate between the closed end and the open end.

6. The aerosol-generating device according to claim 4, wherein the susceptor material comprises a plurality of susceptor fibres interwoven with the woven material of the tubular substrate.

7. The aerosol-generating device according to claim 3, wherein the susceptor material comprises a plurality of areas of susceptor material each supported by a portion of the tubular substrate, and wherein the plurality of areas of susceptor material are spaced apart from each other.

8. The aerosol-generating device according to claim 7, wherein the chamber comprises a closed end and an open end, and wherein the plurality of areas of susceptor material are spaced apart from each other along a length of the tubular substrate between the closed end and the open end.

9. The aerosol-generating device according to claim 8, wherein the inductor coil comprises a plurality of inductor coils, wherein the elastic susceptor element comprises a total number of areas of susceptor material, and wherein each inductor coil of the plurality of inductor coils is disposed around less than the total number of areas of susceptor material.

10. The aerosol-generating device according to claim 9, wherein each inductor coil of the plurality of inductor coils is disposed around only one area of the total number of areas of susceptor material.

11. The aerosol-generating device according to claim 1, further comprising a tubular housing part, wherein the elastic susceptor element comprises a central portion disposed within the tubular housing part, a first end portion extending out of a first end of the tubular housing part, and a second end portion extending out of a second end of the tubular housing part.

12. The aerosol-generating device according to claim 11, wherein the first end portion of the elastic susceptor element is folded around the first end of the tubular housing part and secured to an outer surface of the tubular housing part, and wherein the second end portion of the elastic susceptor element is folded around the second end of the tubular housing part and secured to the outer surface of the tubular housing part.

13. The aerosol-generating device according to claim 1, wherein the chamber comprises a closed end, and wherein the aerosol-generating device further comprises a projection extending into the chamber from the closed end.

14. The aerosol-generating device according to claim 13, wherein at least a portion of the inductor coil is disposed around at least a portion of the projection, and wherein the projection comprises a susceptor material.

15. An aerosol-generating system, comprising:

an aerosol-generating device according to claim 1; and an aerosol-generating article having an aerosol-forming substrate and being configured for use with the aerosol-generating device.

16. An elastic susceptor element for heating an aerosol-generating article, the elastic susceptor element having a tubular shape configured to receive at least a portion of an aerosol-generating article within the elastic susceptor element.

17. The elastic susceptor element according to claim 16, wherein the elastic susceptor element comprises a tubular substrate and a susceptor material supported by the tubular substrate.

18. The elastic susceptor element according to claim 17, wherein the tubular substrate comprises a woven material.

19. The elastic susceptor element according to claim 18, wherein a thread count of the woven material varies along a length of the tubular substrate.

20. The elastic susceptor element according to claim 18, wherein the susceptor material comprises a plurality of susceptor fibres interwoven with the woven material of the tubular substrate.

* * * * *